US005411408A

United States Patent [19]

DiViesti et al.

[11] Patent Number: 5,411,408

[45] Date of Patent: May 2, 1995

[54] ELECTRICAL CONNECTOR FOR PRINTED CIRCUIT BOARDS

[75] Inventors: Anthony M. DiViesti, Arlington Heights; Kent E. Regnier, Lombard, both of Ill.

[73] Assignee: Molex Incorporated, Lisle, Ill.

[21] Appl. No.: 293,364

[22] Filed: Aug. 19, 1994

[51] Int. Cl.[6] ..... H01R 13/00

[52] U.S. Cl. ..... 439/326

[58] Field of Search ..... 439/296, 326–328, 439/629–637

[56] References Cited

U.S. PATENT DOCUMENTS

| | | | |
|---|---|---|---|
| 5,226,833 | 7/1993 | Lwee | 439/326 |
| 5,249,988 | 10/1993 | Lu | 439/326 X |
| 5,256,078 | 10/1993 | Lwee et al. | 439/326 |
| 5,326,276 | 7/1994 | Cheng | 439/326 |

*Primary Examiner*—Khiem Nguyen
*Attorney, Agent, or Firm*—Charles S. Cohen

[57] ABSTRACT

An electrical connector includes an elongated dielectric housing having an elongated slot disposed generally along a longitudinal axis of the housing for receiving, edgewise, a printed circuit board. A plurality of terminals are inserted through a bottom terminating face of the housing into a plurality of passages along at least one side of the slot. Each terminal includes a retention portion press-fit in a retention section of a respective passage. The retention section includes inner side walls and an outer side wall which guides, locates and supports the retention portion and, thereby, the terminal within its respective passage. The retention area of the outer side wall is substantially greater than the retention area of the inner side walls.

17 Claims, 5 Drawing Sheets

ELECTRICAL CONNECTOR FOR PRINTED CIRCUIT BOARDS

FIELD OF THE INVENTION

This invention generally relates to the art of electrical connectors and, particularly, to an edgecard connector having spring arm contacts for engaging circuit traces on a printed circuit board.

BACKGROUND OF THE INVENTION

One type of electrical connector commonly is called an "edgecard" connector in that it includes an elongated housing having an elongated slot for receiving, edgewise, a printed circuit board. The connector includes a plurality of terminals mounted along one or both sides of the slot for making electrical contact with circuit traces adjacent the edge of the circuit board.

The terminals which often are used in edgecard connectors are press-fit terminals having stamped and formed spring arm contacts for mechanically and electrically engaging the circuit traces on the printed circuit board. A problem which consistently surfaces in the design of such edgecard connectors is the dilemma of providing high normal forces which are associated with undesirably high insertion forces of the board into the connector. In order to provide satisfactory mating between the board and the spring arm contacts, a sufficient normal force must be created to assure the desired electrical contact. A typical edgecard connector includes parallel opposing rows of terminals having spring arm contacts extending toward each other and defining convex contact engaging surfaces engageable with the circuit board. The spring arms act as cantilever beams, so that when a board is slidably inserted therebetween, the ends of the spring arm contacts are forced laterally apart. Typically, the higher the normal force provided, the greater the insertion force.

One solution to the above problem of balancing high normal contact forces with undesirable high insertion forces has been to "preload" the terminals. In other words, when the terminals are press-fit into respective passages in the connector housing, the cantilevered spring arms are preloaded or "cocked" against their resiliency and held or preloaded in that condition behind retaining shoulders of the connector housing.

While preloaded terminals are effective to solve certain problems, as described above, they have the potential of creating more serious problems, particularly when relatively long connector housings are exposed to relatively high processing temperatures. Specifically, an edgecard connector often interconnects a first printed circuit board received edgewise in the connector, as described above, with a second printed circuit board by soldering processes which require the application of heat. When an elongated connector housing is exposed to high heat, the plastic material of the housing may soften, and the preloaded terminals apply pressure to the housing which tends to collapse the softened housing along the boardreceiving slot. The housings could be fabricated of materials which do not collapse under the forces of the preloaded terminals, but such materials often are cost prohibitive.

In order to solve the myriad of problems outlined above, attempts have been made to control the inserted location of the terminals and, thereby, avoid the use of terminals having preloaded spring contact portions. For instance, it has been proposed to provide each terminal with a retention portion that is press-fit in a retention section of a respective terminal-receiving passage in the connector housing. In one proposal, the retention section of the passage essentially grips the edges of the retention portion of the terminal as the terminal is inserted into its passage. The retention section of the passage may be tapered to guide the terminal during insertion as the retention section grips the edges of the terminal. When the terminal is fully inserted, a narrower area of the tapered retention section fully grips the edges of the retention portion by a press-fit. In some applications, problems have been encountered in controlling the insertion location of the terminals.

Another solution has been to use additional insertion tooling as a back-up to the retention portion of the terminal to properly guide the terminal during insertion and eventually locate the fully inserted terminal. Once the terminal is fully inserted, the additional guiding tooling is removed. However, not only does the connector housing have to be designed to accommodate the additional guiding and supporting tooling, but the tooling adds expenses in both the tooling, itself, as well as the processing equipment used in conjunction with the tooling.

The present invention is direction to solving these problems by providing means directly on the connector housing for guiding, locating and supporting the terminals within the connector housing.

SUMMARY OF THE INVENTION

An object, therefore, of the invention is to provide a new and improved electrical connector of the character described, particularly an improved edgecard connector having terminals with spring contact portions for engaging a printed circuit board.

In the exemplary embodiment of the invention, an electrical connector is provided for receiving an edge of a printed circuit board having contact pads adjacent the edge of the board. The connector includes an elongated dielectric housing having a board-receiving face and a terminating face. An elongated slot is disposed in the board-receiving face generally along a longitudinal axis of the housing for receiving the edge of the printed circuit board. A plurality of terminal receiving passages communicate between the faces along at least one side of the slot. The terminal receiving passages have a terminal retention section into which a press-fit portion of a terminal is inserted. The terminal retention section has a pair of opposed end walls generally perpendicular to the longitudinal axis and a pair of opposed side wall means generally parallel to the longitudinal axis. A plurality of terminals are insertable into the terminal receiving passages through the terminating face of the housing. Each terminal is secured within one of the passages and includes a tail portion projecting from the housing, a press-fit portion press-fit into the terminal retention section of a respective passage in an insertion direction, and a cantilevered spring contact portion extending between the press-fit portion and a free end of the terminal. The press-fit portion is generally planar and generally parallel to the longitudinal axis. The spring contact portion projects into the slot for engaging a contact pad on the printed circuit board, with the spring contact portion being spaced from the housing along its entire length between the press-fit portion and the free end.

The invention contemplates that one of the opposed side wall means of each retention section located nearest the slot, defines a surface means against which the press-fit portion of the terminal is engageable and which is substantially open to allow insertion of the terminal into the respective passage through the terminating face of the housing. The other of the opposed side wall means located furthest from the slot is generally planar and provides a substantially greater surface area than the surface means defined by the side wall means nearest the slot. The side wall means furthest from the slot provides means for guiding, locating and supporting the generally planar press-fit portion of the terminal.

Preferably, the terminals are stamped and formed of sheet metal material. The spring contact portions of the terminals form cantilevered spring contact arms, and the terminal portions of the terminals form solder tails projecting from the housing.

As disclosed herein, the retention portion of each terminal is wider than immediately adjacent portions of the terminal. Each retention section includes edge walls for press-fittingly engaging the end walls of the retention portion of a respective passage in a direction generally parallel to the axis. The housing includes a plurality of webs extending perpendicular to the longitudinal axis to define the end walls of the terminal receiving passages.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
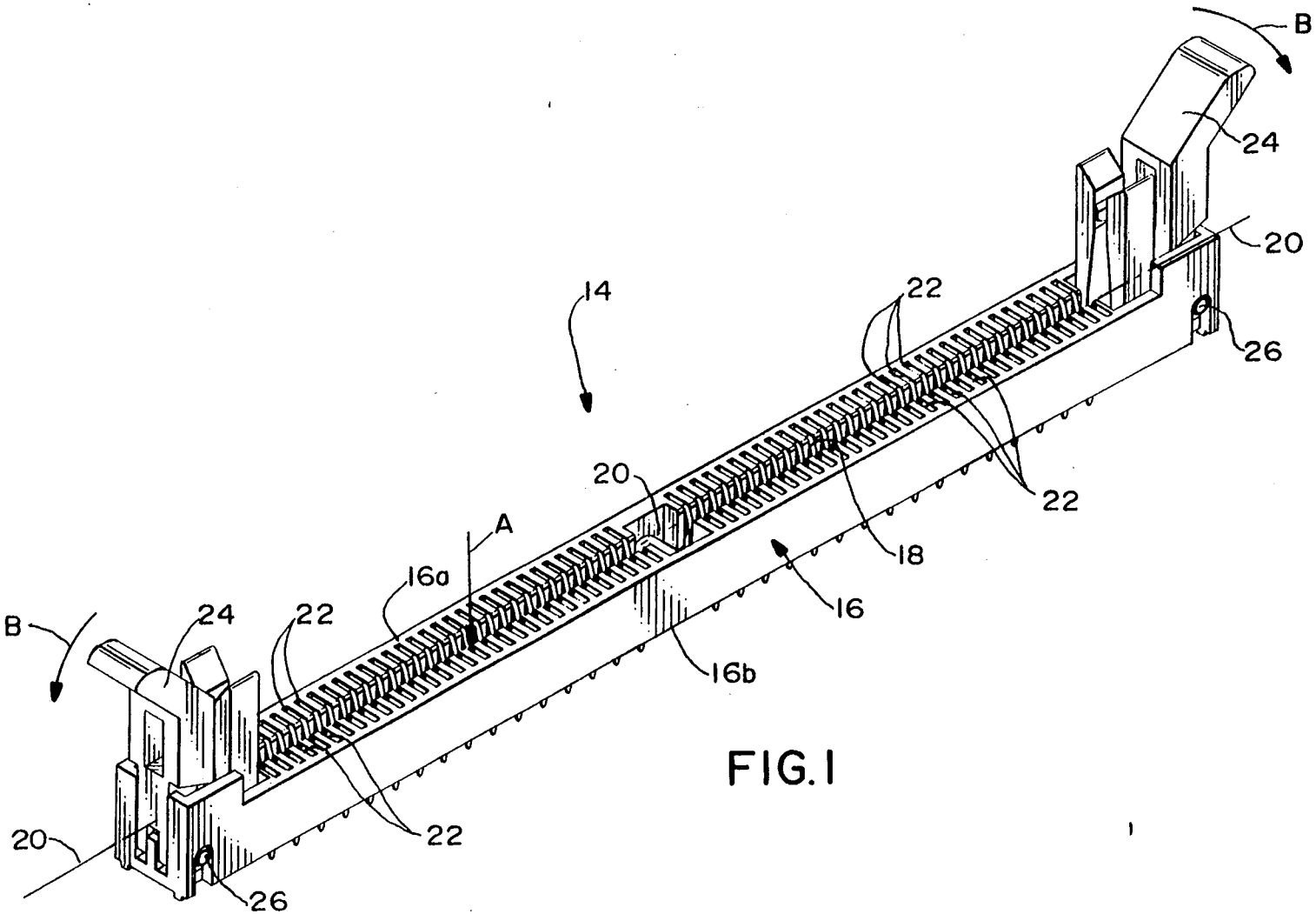
FIG. 1 is a perspective view of an electrical connector of the type for incorporating the invention.

Referring to the drawings in greater detail, and first to FIG. 1, the invention is embodied in an edgecard electrical connector, generally designated 14, which includes a dielectric housing, generally designated 16, unitarily molded of plastic material. The housing has a board-receiving face 16*a* and a terminating face 16*b* to be positioned adjacent a mother board upon mounting of the connector. As can be seen, the housing is considerably elongated and defines an elongated slot 18 disposed in board-receiving face 16*a* generally along a longitudinal axis 20 of the housing for receiving, edgewise, a printed circuit board (not shown). The printed circuit board has a plurality of circuit pads or contacts spaced longitudinally adjacent an insertion edge of the board, as is known in the art.

Connector 14 is shown as a "dual readout" connector in that the printed circuit board will have electrically distinct circuit pads on both sides thereof adjacent the insertion edge of the board. Correspondingly, elongated housing 16 has a plurality of terminal-receiving passages 22 spaced longitudinally of the housing on each opposite side of longitudinal slot 18. The printed circuit board is inserted into the slot in the direction of arrow "A", whereupon a spring contact portion 32 of each terminal within passage 22 establishes mechanical and electrical contact with one of the circuit pads of the board at the edge thereof. The connector has latching and ejection lever 24 pivotally mounted at each end of housing at 26 for facilitating latching and ejection of an inserted printed circuit board from slot 18. The latching and ejection levers are generally known in the art and are effective for engaging the inserted edge of the printed circuit board, or a shoulder portion of the board, to eject the printed circuit board opposite the direction of arrow "A", when the ejection levers are pivoted in the direction of arrows "B".

Figure 2:
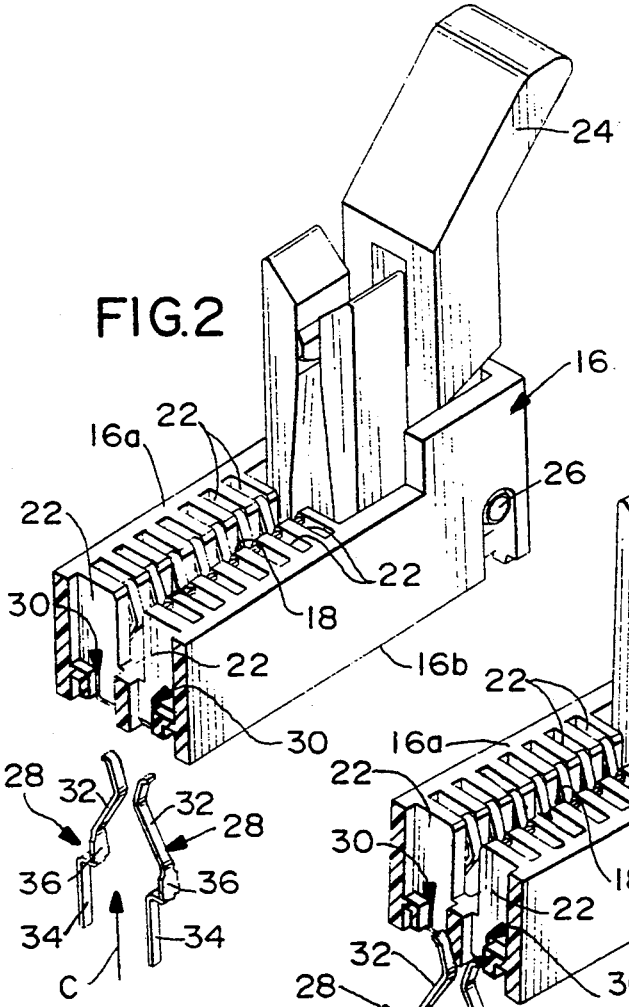
FIG. 2 is a fragmented perspective view of the right-hand end of the connector of FIG. 1, with a pair of the terminals removed to facilitate the illustration.
Figure 3:
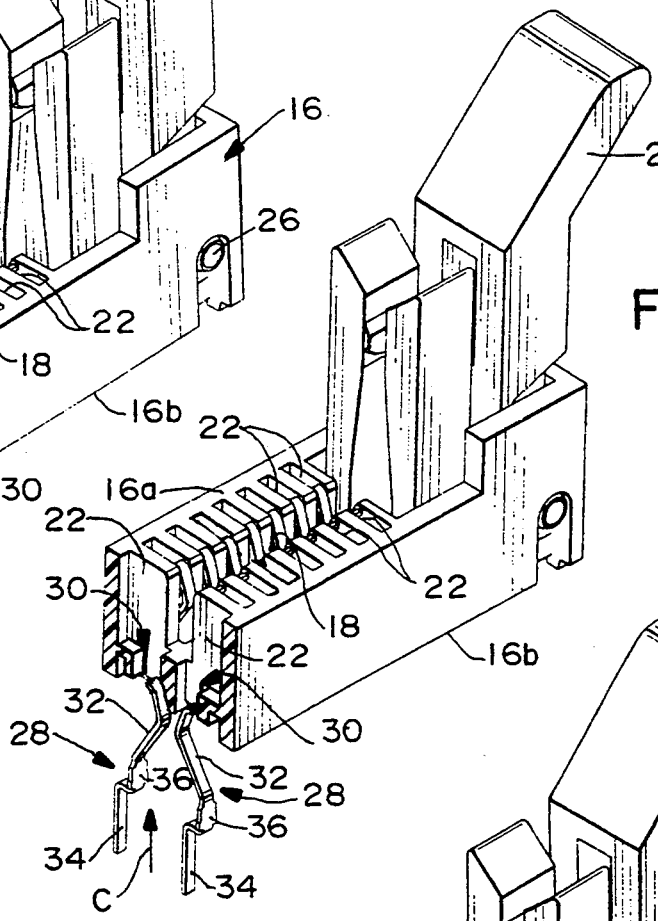
FIG. 3 is a view similar to that of FIG. 2, with the terminals about to be inserted into their respective passages.
Figure 4:
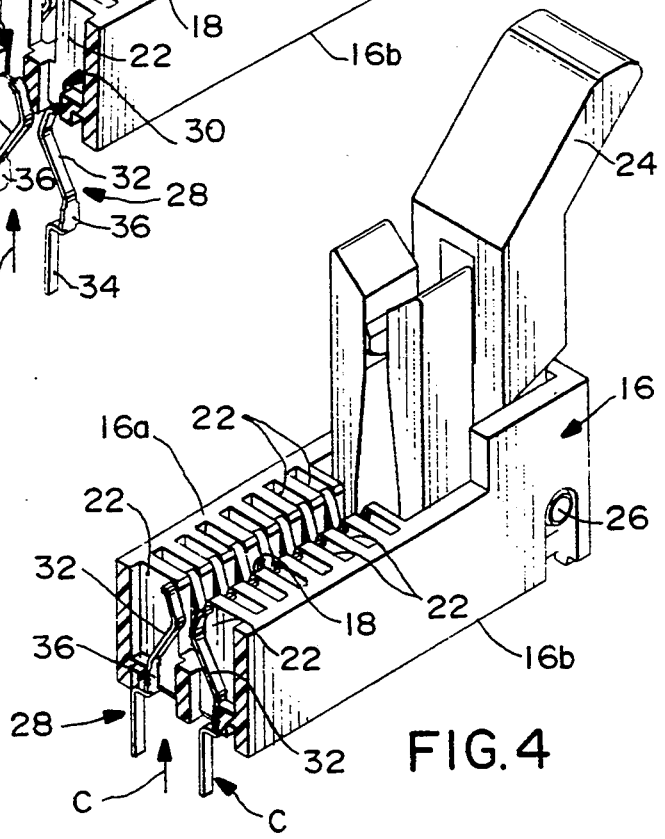
FIG. 4 is a view similar to that of FIGS. 2 and 3, with the terminals fully inserted into their passages.

FIGS. 2–4 show a pair of terminals, generally designated 28, for insertion into respective terminal-receiving passages 22 in the direction of arrows "C". In other words, the terminals are "bottom-loaded" or inserted into the passages through terminating face 16*b* of the housing. The terminals are stamped and formed of sheet metal material, and the terminals of each pair are identical but oriented in opposite directions so as to be mirror images of each other when inserted into a pair of passages 22 on opposite sides of slot 18 in connector housing 16. Each terminal-receiving passage 22 includes a retention section, generally designated 30, for purposes described hereinafter.

Each terminal 28 includes a spring contact portion 32 which, when inserted into a respective passage 22, projects into slot 18 for engaging a respective circuit trace on the inserted printed circuit board. Each terminal includes a tail portion 34 projecting from housing 16, when the terminal is fully inserted as shown in FIG. 4. In the disclosed embodiment, tail portions 34 form solder tails for insertion into holes in a second printed circuit board for solder connection to circuit traces on the board and/or in the holes. Lastly, each terminal 28 includes a retention portion 36 which is wider than spring contact portion 32 and tail portion 34. The retention portions of the terminals are press-fit into retention sections 30 of terminal-receiving passages 22.

FIGS. 2–4 are sequential views of the steps of insertion of terminals 28 into passages 22. In FIG. 2, the terminals are completely removed from the housing and the respective passages. In FIG. 3, the tips of spring contact portions 32 of the terminals have begun to enter passages 22 through terminating face **16*b* of the housing. In FIG. 4, the terminals are completely inserted into passages 22, with retention portions 36 of the terminals press-fit into retention sections 30 of the passages. When fully inserted, as shown in FIG. 4, spring contact portions 32 of the terminals project into slot 18** for engaging the respective circuit traces at the edge of the printed circuit board. The spring contact portions are spaced from the housing along their entire lengths.

Figure 5:
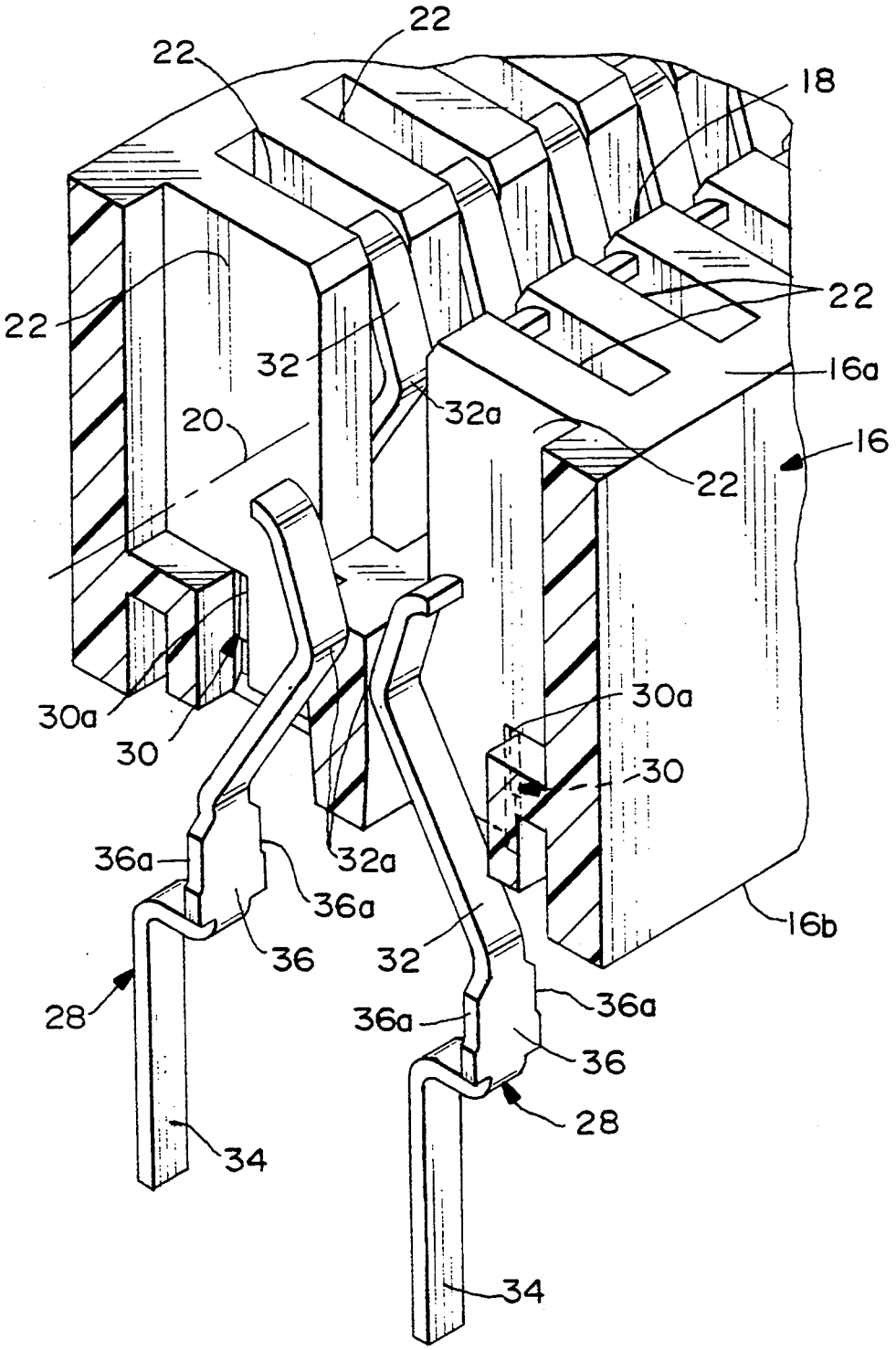
FIG. 5 is an enlarged fragmented view of a pair of the terminals partially inserted into their respective passages.
Figure 6:
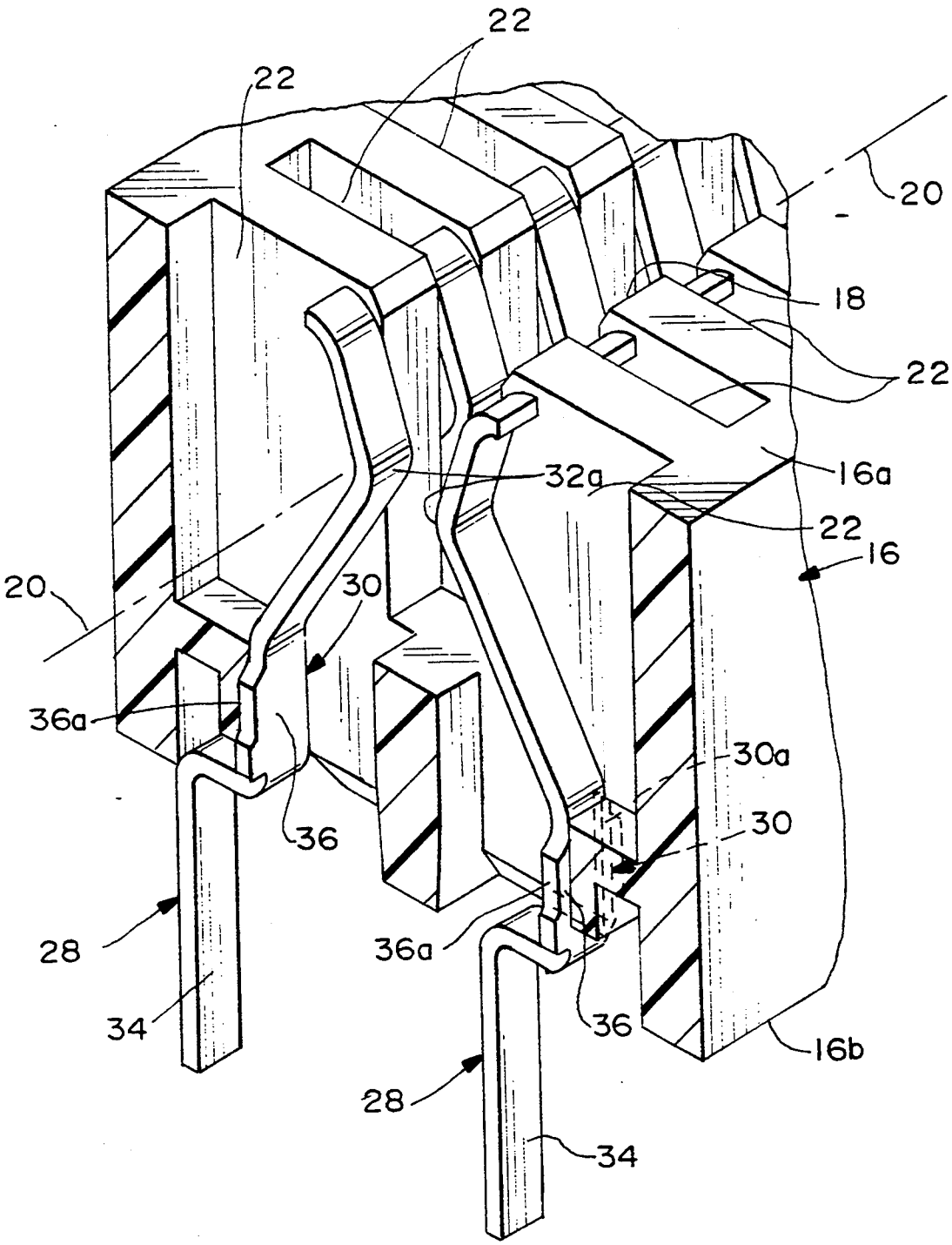
FIG. 6 is a view similar to that of FIG. 5, with the terminals fully inserted into the passages.

FIGS. 5 and 6 are enlarged depictions somewhat similar to the illustrations depicted by FIGS. 2–4, in order to better illustrate the shapes of terminals 28, terminal-receiving passages 22 and retention sections 30. With the terminals being stamped and formed of sheet metal material, it can be seen that spring contact portions 32 are bent or formed to define convex contact engaging surfaces **32*a*. These surfaces will be exposed within slot 18 for contacting the contact pads on the inserted printed circuit board. It also can be seen that retention portions 36 of the terminals are stamped to be wider than spring contact portions 32 and terminal portions 34. The retention portions have stepped edges 36*a*. Retention sections 30 of passages 22 also have longitudinal end walls 30*a* which are molded with stepped configurations corresponding to the configurations of edges 36*a* of the terminal retention portions 36. Upon securing retention portions 36 within the housing, spring contact portions 32 are free to deflect within passages 22 transversely of slot 18** in order to provide normal forces between the spring contact portions and the contact pads on the inserted printed circuit board.

Figure 7:
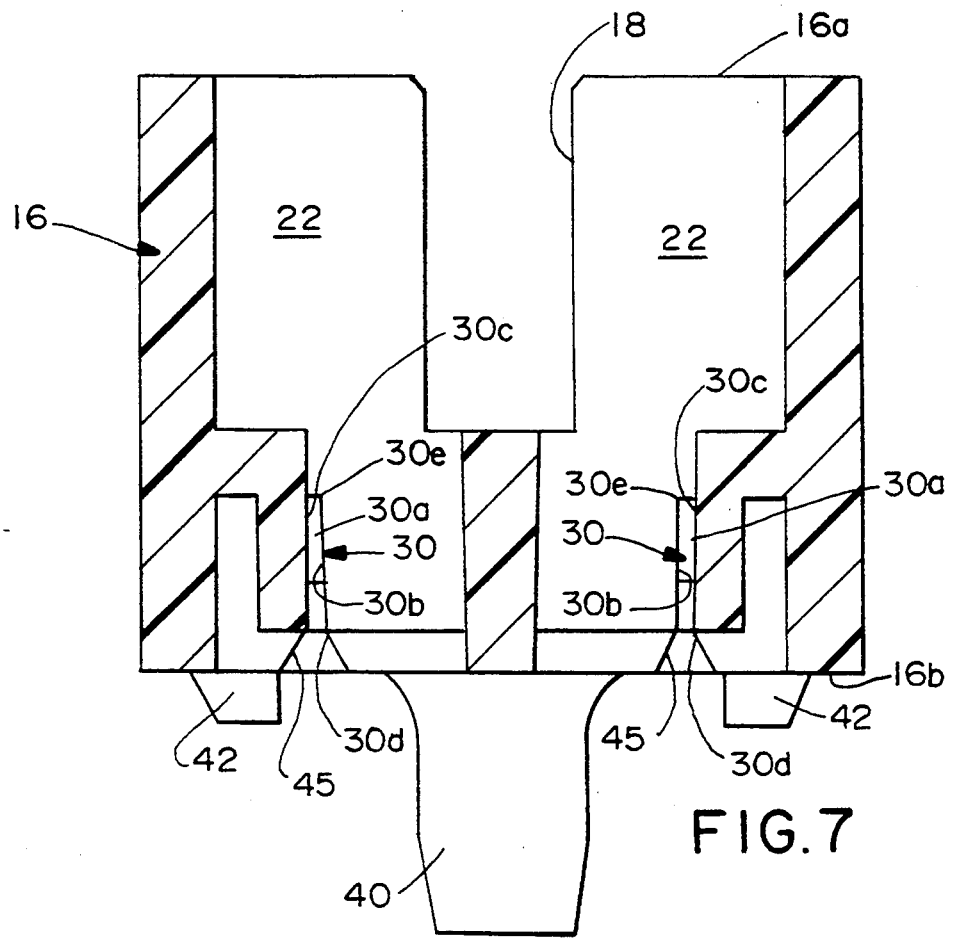
FIG. 7 is a section through the housing illustrating the configuration of the retention section of a terminal-receiving passage.
Figure 9:
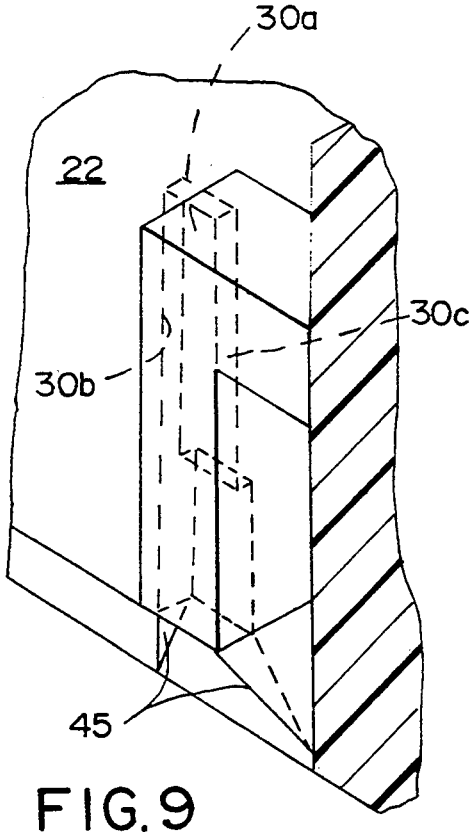
FIG. 9 is an enlarged, fragmented perspective view of an alternate embodiment of the terminal retention section.

FIGS. 7 and 9 show an enlarged illustration of one of the retention sections 30 on each opposite side of each terminal-receiving passage 22 for receiving and establishing a press-fit with the retention portion 36 of one of the terminals 28. FIG. 7 also shows one of a plurality of mounting pegs 40 and two of a plurality of standoffs 42 molded integrally with and projecting from terminating face **16*b* of housing 16. As is known in the art, mounting pegs 40 are inserted into appropriate mounting holes in the mother board, and standoffs 42 are provided to space the housing from the mother board for solder reflow processing purposes. Finally, FIGS. 7 and 9 show that the housing is formed with lead-in or guide surfaces 45 leading to a mouth 30*d* of each retention section 30** to guide a terminal thereinto.

Figure 8:
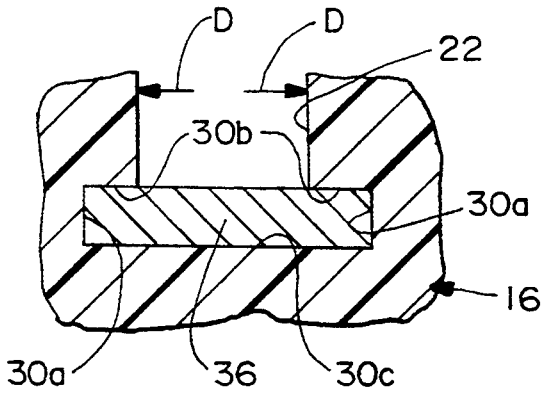
FIG. 8 is a schematic, fragmented sectional view taken generally along a horizontal line through a terminal and the terminal retention section of the housing.

More particularly, in referring to each retention section 30 in FIG. 7, the retention section has a pair of inner lateral side walls **30*b* nearest board-receiving slot 18 and an outer lateral side wall 30*c* furthest from the slot. Side walls 30*b* and 30*c* are generally parallel to each other. It can be seen in FIG. 8 that side walls 30*b* of each retention section are spaced apart to allow insertion of a respective terminal into the open terminal-receiving passage 22. However, the outer lateral side wall 30*c*, furthest from the slot, is shown in FIGS. 7 and 8 as being "solid." In other words, outer side wall 30*c* is generally planar and provides means for guiding, locating and supporting substantially the entire surface area of the generally planar press-fit retention portion 36 of the terminal. In essence, inner side walls 30*b* grip the retention portion of the terminal along the surface adjacent its edges, while outer side wall 30*c*** grips and supports the retention portion along substantially its entire outer planar surface.

FIG. 8 best shows the manner in which the terminals are gripped. It can be seen how inner side walls **30*b* engage terminal retention section 36 adjacent its edges, while leaving terminal-receiving passage 22 open, as indicated by arrows "D". This allows for the terminal to be inserted into the passage through the bottom or terminating face 16*b* of housing 16. On the other hand, outer side wall 30*c*** engages the entire outer planar surface of the retention portion. This solid back-up portion of the connector housing guides, locates and supports the terminal retention portion and, therefore, the terminal during insertion and in its final inserted position.

The distance between side walls **30*b* and side wall 30*c* is less than the thickness of retention portion 36 of a respective terminal. Therefore, there always will be an interference fit or a press-fit along substantially the entire length or height of retention section 30**.

It can be understood from the foregoing that the terminal retention area of side walls **30*b* is smaller than the terminal retention area of side wall 30*c*. Therefore, the pressure over side wall 30*c* is less than the pressure over side walls 30*b*. As a result, substantially all skiving or displacement of the plastic material of housing 16 that holds the terminal in place will occur along side walls 30*b* rather than along side wall 30*c***.

As described above and shown in the drawings, particularly FIGS. 7 and 8, side wall **30*c* is described and depicted as being "solid," i.e. the full width of retention portion 36. This is the preferred embodiment of the invention but not necessarily required. For instance, as shown in FIG. 9, it is possible to provide a slot in side wall 30*c* perpendicular to terminal retention portion 36 whereby a pair of walls would be formed opposing side walls 30*b*, provided that the terminal retention area of the pair of walls is sufficiently greater than the retention area of side walls 30*b* to result in the desired pressure differential which will cause skiving of walls 30*b*** to effect the interference fit.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for receiving an edge of a printed circuit board having contact pads adjacent the edge of the board, comprising:

an elongated dielectric housing having a board-receiving face and a terminating face, an elongated slot disposed in the board-receiving face generally along a longitudinal axis of the housing for receiving said edge of the printed circuit board, and a plurality of terminal receiving passages communicating between the faces along at least one side of the slot, said terminal receiving passages each having a terminal retention section into which a press-fit portion of a terminal is inserted, said terminal retention section having a pair of opposed end walls generally perpendicular to said longitudinal axis and first and second opposed side wall means generally parallel to said longitudinal axis, said opposed side wall means being generally parallel and spaced apart a predetermined first distance;

a plurality of terminals, each terminal being insertable into one of said terminal receiving passages through the terminating face of the housing and secured therein, each terminal including a tail portion projecting from the housing, a press-fit portion press-fit into said terminal retention section of a respective passage in an insertion direction, said press-fit portion being generally planar and generally parallel to said longitudinal axis and having a predetermined thickness, said predetermined thickness being greater than said predetermined first distance, and a cantilevered spring contact portion extending between said press-fit portion and a free end of said terminal and projecting into the slot for engaging a contact pad on the printed circuit board, said spring contact portion being spaced from said housing along its entire length between said press-fit portion and said free end;

said first side wall means of each terminal retention section being located nearest said slot and defining a surface means against which the press-fit portion of the terminal is engageable and which is substantially open to allow insertion of a respective terminal into the respective passage through the terminating face of the housing; and said second side wall means being located furthest from said slot and being generally planar and providing means for guiding, locating and supporting the generally planar press-fit portion of the terminal, said second side wall means providing a substantially greater surface area in contact with said press-fit portion of said terminal than said first side wall means.

2. The electrical connector as set forth in claim 1 wherein said terminals comprise stamped and formed sheet metal members.

3. The electrical connector as set forth in claim 2 wherein said spring contact portions of the terminals comprise formed spring contact arms and the tail portions of the terminals comprise solder tails projecting from the housing.

4. The electrical connector as set forth in claim 1 wherein said housing includes a plurality of webs extending perpendicular to said longitudinal axis to define the end walls of said terminal receiving passage.

5. The electrical connector as set forth in claim 1 wherein said second side wall means continuously engages said press-fit portion of said terminal along substantially the entire dimension of said press-fit portion in a direction generally parallel to said longitudinal axis.

6. The electrical connector as set forth in claim 1 wherein said second side wall means includes a pair of spaced apart planar walls.

7. The electrical connector as set forth in claim 1 wherein said opposed end walls are positioned a predetermined second distance apart and said predetermined second distance is less than the dimension of said press-fit portion in a direction generally parallel to said longitudinal axis.

8. The electrical connector as set forth in claim 5 wherein said opposed end walls are positioned a predetermined second distance apart and said predetermined second distance is less than the dimension of said press-fit portion in a direction generally parallel to said longitudinal axis.

9. The electrical connector as set forth in claim 6 wherein said opposed end walls are positioned a predetermined second distance apart and said predetermined second distance is less than the dimension of said press-fit portion in a direction generally parallel to said longitudinal axis.

10. An electrical connector, comprising:

an elongated dielectric housing having a board-receiving face and a terminating face, an elongated slot disposed generally along a longitudinal axis of the housing for receiving, edgewise, a printed circuit board having circuit traces adjacent the edge of the board, and a plurality of terminal-receiving passages along at least one side of the slot, each passage including a retention section defined by a pair of spaced apart inner side walls located nearest said slot and outer side wall means located furthest from the slot, said inner side walls and said outer side wall means being generally parallel and spaced apart a predetermined first distance, the inner side walls being spaced apart to allow insertion of a terminal into the respective passage past said inner side walls, and the outer side wall means having a substantially greater surface area than the inner side walls adapted for engaging a retention portion of a terminal inserted therein; and a plurality of terminals insertable into the passages through the terminating face of the housing, each terminal including a retention portion press-fit in the retention section of a respective passage, whereby said outer side wall means of the retention section provides means for guiding, locating and supporting the retention portion of the terminal.

11. The electrical connector of claim 10 wherein said terminals comprise stamped and formed sheet metal members.

12. The electrical connector of claim 10 wherein said outer side wall means extend substantially entirely across the retention section.

13. The electrical connector of claim 10 wherein said outer side wall means continuously engages said retention portion of said terminal along substantially the entire dimension of said retention portion in a direction generally parallel to said longitudinal axis.

14. The electrical connector of claim 10 wherein said outer side wall means includes a pair of spaded apart planar walls.

15. The electrical connector as set forth in claim 10 wherein said opposed end walls are positioned a predetermined second distance apart and said predetermined second distance is less than the dimension of said retention portion in a direction generally parallel to said longitudinal axis.

16. The electrical connector as set forth in claim 13 wherein said opposed end walls are positioned a predetermined second distance apart and said predetermined second distance is less than the dimension of said retention portion in a direction generally parallel to said longitudinal axis.

17. The electrical connector as set forth in claim 14 wherein said opposed end walls are positioned a predetermined second distance apart and said predetermined second distance is less than the dimension of said retention portion in a direction generally parallel to said longitudinal axis.

* * * * *